US005110128A

United States Patent [19]

Robbins

[11] Patent Number: 5,110,128

[45] Date of Patent: May 5, 1992

[54] AIR CUSHION TABLE GAME

[76] Inventor: Mark J. Robbins, P.O. Box 185515, Ft. Worth, Tex. 76181

[21] Appl. No.: 658,519

[22] Filed: Feb. 21, 1991

[51] Int. Cl.[5] ..... A63F 7/07; A63F 7/30

[52] U.S. Cl. ..... 273/126 A; 273/126 R; 273/127 R; 273/127 C

[58] Field of Search ..... 273/126 R, 126 A, 127 R, 273/127 A, 127 B, 127 C, 127 D, 41

[56] References Cited

U.S. PATENT DOCUMENTS

| | | | |
|---|---|---|---|
| 2,521,563 | 9/1950 | Beck | 273/126 R |
| 2,565,238 | 8/1951 | Koci | 273/41 |
| 2,634,130 | 4/1953 | Beck et al. | 273/127 R |
| 3,202,427 | 8/1965 | Patent | 273/126 R |
| 3,841,632 | 10/1974 | Schwartz | 273/126 R |
| 3,865,377 | 2/1975 | Cooper et al. | 273/126 R |
| 3,887,187 | 6/1975 | Crossman et al. | 273/126 A |
| 3,913,918 | 10/1975 | Trachtonar | 273/126 R |
| 4,017,078 | 4/1977 | Goldfarb et al. | 273/126 A |
| 4,173,341 | 1/1979 | Olliges | 273/126 A |
| 4,215,863 | 8/1980 | Kuiper | 273/126 R |

OTHER PUBLICATIONS

Brochure—Brunswick's Thunderbolt Air—Hockey—Remco—1 page.

*Primary Examiner*—Edward M. Coven
*Assistant Examiner*—Raleigh W. Chiu
*Attorney, Agent, or Firm*—Gerstman & Ellis, Ltd.

[57] ABSTRACT

An air cushion table game comprises a playfield which has an air cushion apparatus so that puck may slide on the playfield in the manner of the known air cushion table games. A goal is provided for receiving the puck at one end of the playfield, while a movable barrier is provided for retaining the puck at the far end of the table to prohibit unauthorized use when the blower motor is shut off upon completion of the game. An obstacle may be carried on the playfield to increase the difficulty of propelling a puck into the goal from the opposite end.

11 Claims, 2 Drawing Sheets

Fig. 1
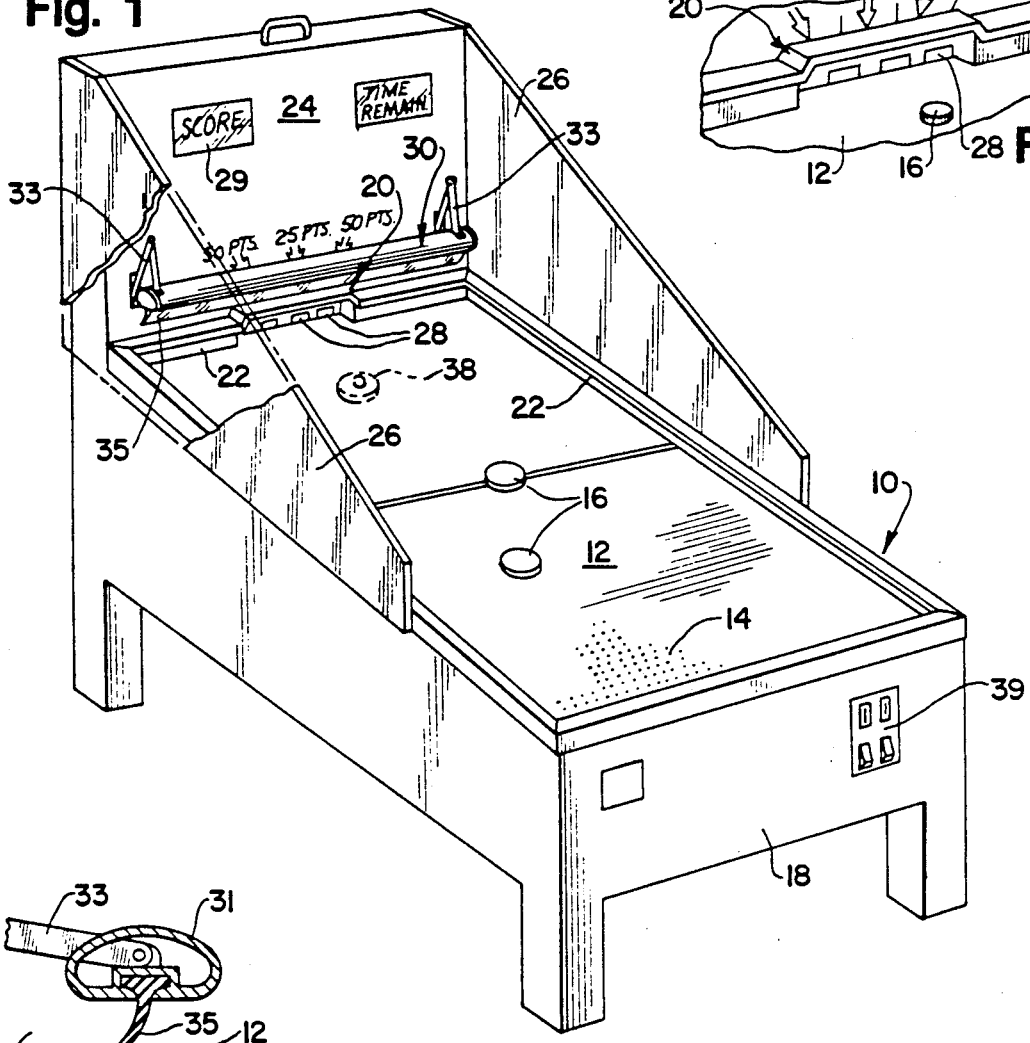
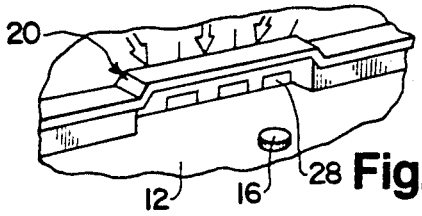
Fig. 2
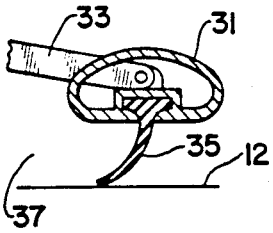
Fig. 4
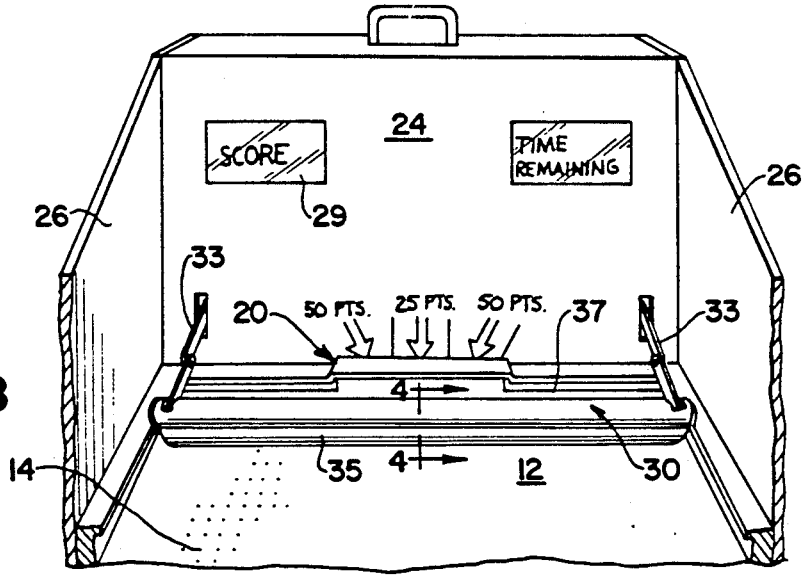
Fig. 3

Fig. 5
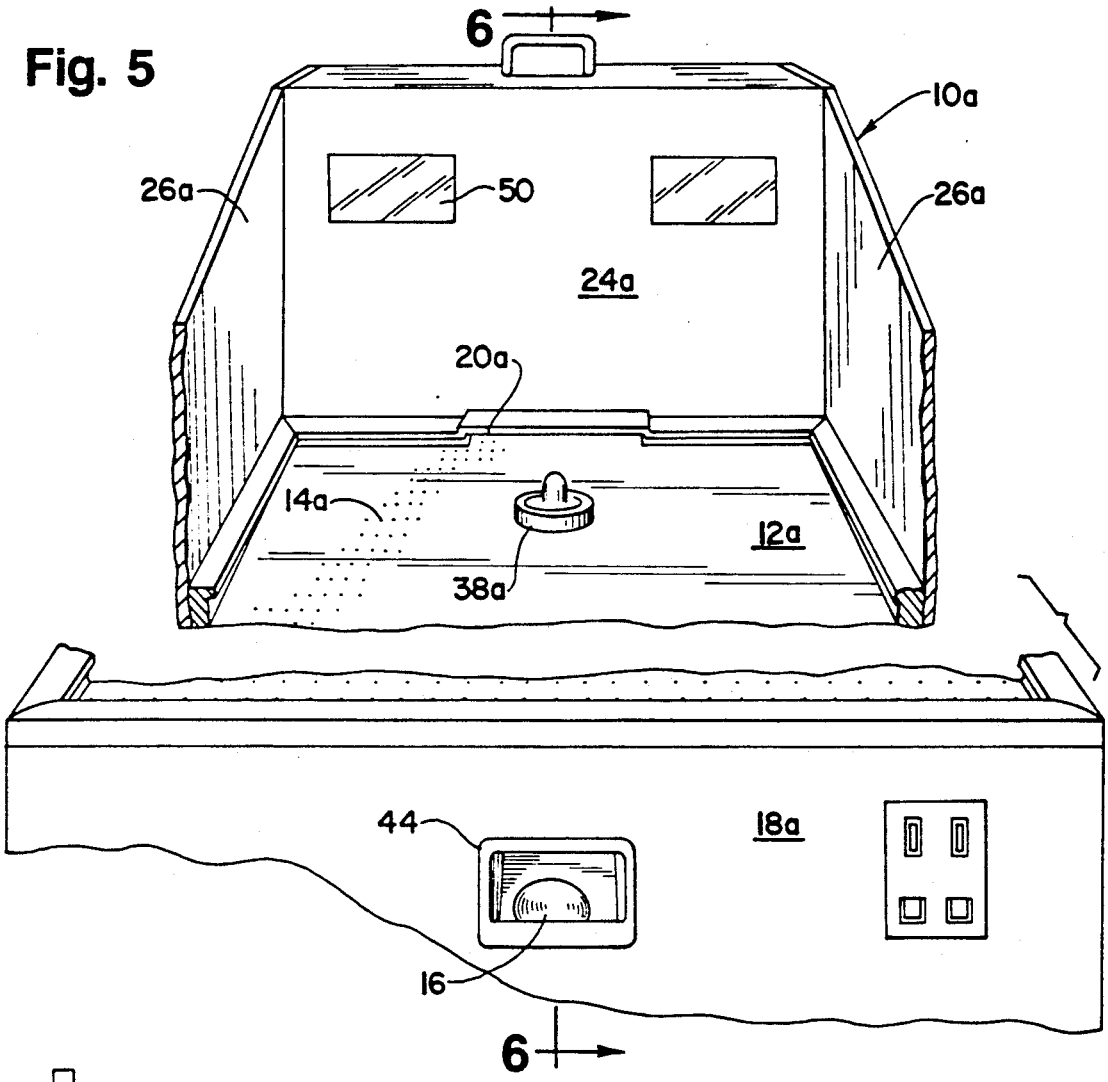
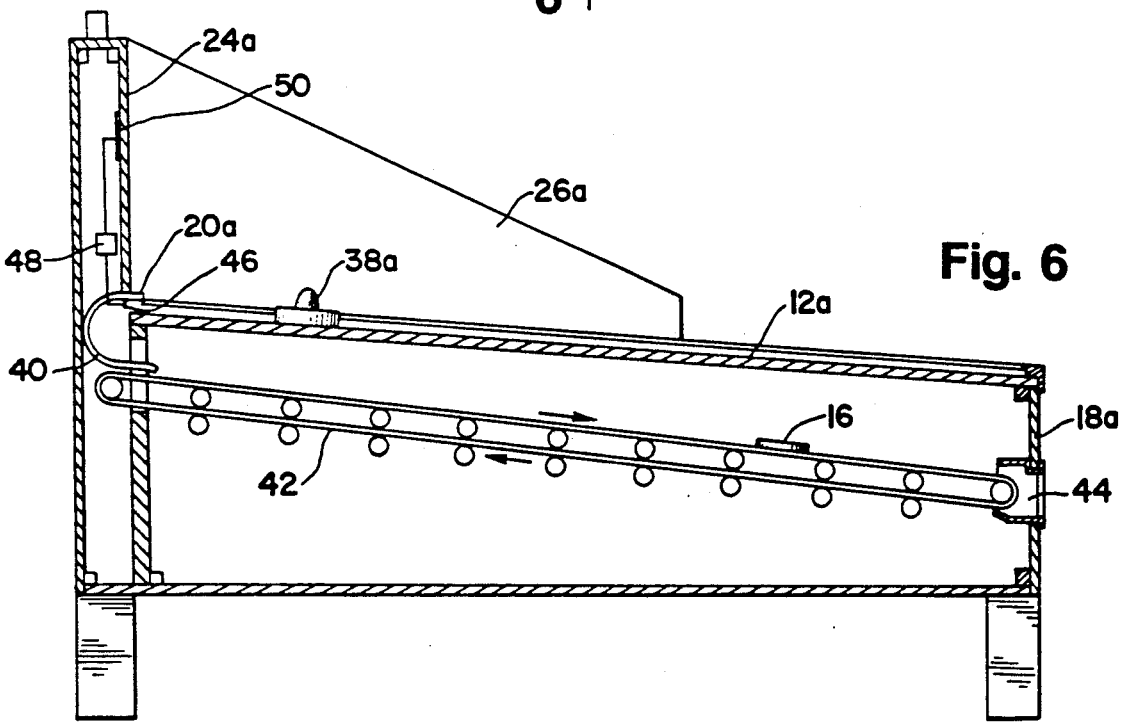
Fig. 6

AIR CUSHION TABLE GAME

Air cushion table games have been in wide use, as disclosed for example in U.S. Pat. Nos. 3,773,325 and 3,887,187, being sold under the trademark Air Hockey. In these table games, the playfield has an array of small holes through which compressed air is pumped. Thus a flat disk or "puck" can float on a cushion of air, giving it a virtually frictionless, live action. Then, typically, a disk-like mallet is used to strike the puck, while each player stands at an opposed end of the playfield from the opponent's goal.

By this invention a modified air cushion table game is provided, in which, typically, the play is typically from one end of the table only, with a target goal being provided at the other end. By this invention, access to the target goal can be automatically limited in a predetermined manner and, additionally, the puck may be stored within the goal during periods of nonuse, to facilitate the use of the air cushion table game as a coin-operated game with minimal supervision by the owner.

Likewise, a modified air cushion table game is disclosed in which the challenge of the target for accurate shooting may be accentuated, for training in Air Hockey skills or simply for the challenge that the Air Hockey game represents.

DESCRIPTION OF THE INVENTION

In this invention, an air cushion table game is provided which comprises a playfield. Means are provided for providing an air cushion for pucks sliding on the playfield, as is conventional. Likewise a goal is provided for receiving pucks at on end of the playfield.

In accordance with this invention, barrier means are provided for retaining the puck at the far end of the table to prohibit unauthorized play when the blower motor is shut off, upon completion of the game. Accordingly, if the machine is of the coin operated variety, at the end of play, a timer can be actuated, to signal a motor that moves the barrier to retain the puck and terminate play until a new coin is inserted.

The barrier means may comprise an elevatable and lowerable bar which is positioned to be lowered in front of the goal at the end of play to prevent further play. Then, upon actuation of the apparatus, the barrier can be raised and preferably pulled to the rear out of the way for added play.

Preferably, the bottom of the barrier bar may carry a flexible strip of rubber or plastic which is angled toward the goal and in substantial contact with the playfield. Thus, pucks can be fired through the barrier by deflecting the angled flexible strip, but the pucks cannot then be returned to the player by moving in the other direction through the barrier since the angled strip prevents such motion.

The table game of this invention may also contain switch or sensor means responsive to the entry of a puck into the goal for scoring. Thus, the puck is less likely to be lost, being stored behind the barrier between plays.

During operation of the game, the puck tends to slide downwardly from the one end where the goal is toward the opposite end where the player is, because the playfield is preferably sloped downwardly from the one end, to cause pucks on the playfield and in the goal to tend to slide toward the end opposite to the one end. This takes place while the air cushion is operating.

As another aspect of this invention, the playfield may carry an obstacle, typically in front of the goal, to increase the difficulty of propelling a puck on the playfield into the goal from the opposite end. For example, the obstacle may be of the shape of a mallet used for batting the pucks in air cushion table games, which is most commonly a disk-shaped object with a central handle projecting from one side thereof. This mallet may be fixed to the playfield, acting as a stationary obstacle.

Additionally, conveyor belt means may be provided, the conveyor belt means being positioned to receive pucks from the goal, and to convey them to the opposite end of the playfield from the goal for replay. The conveyor belt typically deposits returned pucks in a receptacle in the wall that faces the player at the opposite end.

DESCRIPTION OF THE DRAWINGS

In the drawings, FIG. 1 is a perspective view, with a portion broken away, of one embodiment of an air cushion table game of this invention;

FIG. 2 is a fragmentary, perspective view of a portion of FIG. 1, shown in interaction with a puck;

FIG. 3 is a fragmentary front perspective view of the air cushion table game of FIG. 1, showing the barrier in blocking position;

FIG. 4 is a fragmentary sectional view taken along line 4—4 of FIG. 3;

FIG. 5 is a broken-away front perspective view of another embodiment of the air cushion table game of this invention; and FIG. 6 is a side sectional view of the air cushion table game of FIG. 5.

DESCRIPTION OF SPECIFIC EMBODIMENTS

Referring to FIGS. 1 through 4, air cushion table game 10 comprises a playfield 12 which includes an array of small holes for the pumping of compressed air, so that a puck 16 may float on the playfield and slide in almost frictionless manner in the manner of the known "air hockey" games.

In this embodiment, one end 18 of the playfield and table game is free of a goal and is proportioned for a player to stand for shooting at goal 20 at the remote end of the table game. Goal 20 can be seen to define a recess in an otherwise essentially complete puck barrier 22 positioned around playfield 12. Additionally, table game 10 may define a backboard 24, also including side panels 26 that extend along part of the sides of playfield 12 from said backboard, to catch flying pucks and to cause them to fall back onto the playfield.

It can be seen from FIG. 1 that inside of goal 20 there are positioned a plurality of targets 28, which targets may be electrically connected in a standard manner to a scoring display 29 on backboard 24, so that the score by a player may be recorded by such display. It can also be seen that the respective targets 28 comprise different values, which may be conventionally computed by electronic means and scored on the backboard 24 as the respective targets are struck by a puck or pucks 16.

Also, table game 10 may define a movable barrier 30. Movable barrier 30 comprises a horizontal bar or rod 31 as shown in FIG. 4 the position of which is controlled by a pair of pivot arms 33, which pivot upwardly and downwardly between positions as shown in FIGS. 1 and 3, carrying bar 31 with them. A blade 35 of flexible rubber and plastic is carried in bar 31, being positioned in the position shown in FIG. 3 to rest against playfield 12 in an angular relation, pointing rearwardly as shown.

Movable barrier 30 may be moved between the two positions shown by a conventional motor which operates pivot arms 33. When the game is in operation, pivot arms 33 are moved to the retracted position as shown in FIG. 1, so that pucks 16 are provided unlimited access to goal 20 and targets 28.

However, when the game is to be terminated, pivot arms 33 are moved by the motor to their second position, which lowers bar 30 and flexible blade 35 into contact with playfield 12 as shown particularly in FIG. 4. It can be seen from FIG. 3 that bar 30 is spaced in front of goal 20 to provide room for pucks to be retained behind bar 30 in this condition, it still is possible for pucks to be fired toward goal 20, passing under blade 35 by deflecting the flexible blade because of the angular relation of the blade to the playfield 12. However, it is substantially impossible for pucks to pass from area 37 behind blade 35 forwardly again toward the user because even a forceful rebound of the puck will be halted by blade 35. It is not capable of deflection in the other direction because of its angular relationship to the playfield which prevents it from moving into perpendicular relation with the playfield. Thus, the pucks may be propelled by the user toward the target, but are then retained by the lowered movable barrier 30, to be stored there until a new game is initiated, typically by the insertion of a coin in slot or slots 39.

A timer may indicate the termination of the game to cause arms 33 to move barrier 30 into its blocking position shown in FIGS. 3 and 4. Otherwise, the termination of the game may be controlled in any desirable manner using microprocessor technology, for example, so that the length of the game is dependent upon the score, or any other desired program.

Playfield 12 may be downwardly sloped from the end of the table having goal 20 toward end 18, to cause pucks on the playfield to tend to slide toward end 18 while the air cushion is activated. Thus, the embodiment of FIGS. 1–4 tends to spontaneously return pucks back to the user after they have been propelled toward goal 20.

If desired, an obstacle 38 may be affixed to the playfield 12 to increase the difficulty of striking targets 28 with a puck 16 from the player's position at end 18 of the game.

Referring to the embodiment of FIGS. 5 and 6, a similar table game is disclosed, in which a playfield 12*a* similar to the previous playfield 12 is provided on a table, for sliding pucks. As before, a backboard 24*a* may be provided, having optional side panels 26*a* in a manner similar to the previous embodiment. As before, the player stands at end 18*a* of table game 10*a* and shoots a puck at goal 20*a* at the other end of the playfield 12*a*.

In this embodiment, as is optionally provided to the previous embodiment, an obstacle 38*a* is affixed to playfield 12*a*, being positioned in front of goal 20*a* to increase the difficulty of propelling a puck on the playfield into the goal from opposite end 18*a*. As before, obstacle 38*a* may, if desired, be of the shape and size of a conventional mallet which is used to hit pucks in Air Hockey games currently sold. Thus, the user is forced to sharpen the accuracy of his shooting in order to get the puck around obstacle 38*a* while still entering goal 20*a*.

As in the previous embodiment, playfield 12*a* is sloped downwardly from the end that carries backboard 24*a* toward end 18*a* so that pucks on the playfield, when the air cushion system is actuated, will tend to slide to end 18*a*.

However, in this embodiment, when a puck enters goal 20*a*, it is not returned to the playfield as in the other embodiment, but is directed through chute 40 onto conveyor belt system 42 where, as shown in FIG. 6, puck 16 is conveyed from the playfield end of backboard 24*a* to end 18*a*. There, puck 16 is deposited into a receptacle from where the user can retrieve it for further play.

Goal 20*a* may carry a switch or striker 46 as a target for pucks 16. When switch 46 is actuated by a puck entering 20*a*, a signal may be sent to microprocessor 48 which computes a score and causes it to be displayed on backboard 24*a* at display panel 50. Microprocessor 48 may also contain a desired timer to control the entire operation of the machine, turning it on and off as may be desired, and providing other correlation functions of the display 50 with machine operations.

The above has been offered for illustrative purposes only, and is not intended to limit the scope of this application, which is as defined in the claims below.

That which is claimed is:

1. An air cushion table game which comprises a playfield; means for providing an air cushion for pucks sliding on said playfield; a goal for receiving said pucks at one end of the playfield; and movable barrier means comprising a horizontal bar for lowering onto said playfield in front of said goal in response to predetermined condition to prevent the return of pucks from the area of said goal to the user, said horizontal bar being also raisable above said playfield to permit free passage of pucks thereunder.

2. The table game of claim 1 in which a backboard is carried at said one end of the playfield, with side panels extending along part of said playfield from said backboard.

3. The table game of claim 2, in which said backboard carries electric scoring means.

4. The table game of claim 1 in which said playfield is sloped downwardly from said one end to cause pucks on the playfield to tend to slide toward the end opposite to said one end while the air cushion is provided.

5. The table game of claim 1 in which said horizontal bar which carries a flexible flap extending downwardly to engage the playfield when the bar is lowered, said flexible flap being angled rearwardly toward said goal when engaging said playfield to permit pucks to slide rearwardly under said flap while preventing pucks from moving forwardly under said flap.

6. The table game of claim 1 in which the playfield carries an obstacle to increase the difficulty of propelling a puck on the playfield into the goal from said opposite end.

7. An air cushion table game which comprises a playfield; means for providing an air cushion for pucks sliding on said playfield; a goal for receiving said pucks at one end of the playfield; and movable barrier means for lowering onto said playfield in front of said goal in response to a predetermined condition to prevent the return of pucks from the area of said goal to the user, said movable barrier means comprising a horizontal bar which carries a flexible flap extending downwardly to engage the playfield when the movable barrier is lowered, said flexible flap being angled rearwardly toward said goal when engaging said playfield to permit pucks to slide rearwardly under said flap while preventing pucks from moving forwardly under said flap; said barrier means being also raisable above said playfield to permit free passage of pucks thereunder, said playfield being sloped downwardly from said one end to cause pucks on the playfield to tend to slide toward the end opposite to said one end while the air cushion is provided.

8. The table game of claim 7 in which a backboard is carried at said one end of the playfield, with side panels extending along part of said playfield from said backboard.

9. The table game of claim 8 in which said backboard carries electric scoring means, and said goal carries sensors electrically connected to said electric scoring means for sensing the striking of pucks within said goal.

10. The table game of claim 7 in which said playfield carries an obstacle to increase the difficulty of propelling a puck on the playfield into the goal from said opposite end.

11. The table game of claim 10 in which said obstacle is of the shape of a mallet used for batting pucks in air cushion table games.

* * * * *